US010462558B2

(12) United States Patent
Silver et al.

(10) Patent No.: US 10,462,558 B2
(45) Date of Patent: Oct. 29, 2019

(54) AUDIO DEVICE

(71) Applicant: Bose Corporation, Framingham, MA (US)

(72) Inventors: Jason Silver, Framingham, MA (US); Ryan C. Struzik, Hopkinton, MA (US)

(73) Assignee: Bose Corporation, Framingham, MA (US)

( * ) Notice: Subject to any disclaimer, the term of this patent is extended or adjusted under 35 U.S.C. 154(b) by 27 days.

(21) Appl. No.: 15/647,749

(22) Filed: Jul. 12, 2017

(65) Prior Publication Data

US 2019/0020948 A1 Jan. 17, 2019

(51) Int. Cl.

| | |
|---|---|
| ***H04R 5/02*** | (2006.01) |
| ***H04R 1/28*** | (2006.01) |
| ***H04R 1/02*** | (2006.01) |
| ***H04R 1/10*** | (2006.01) |
| ***H04R 1/22*** | (2006.01) |

(52) U.S. Cl.

CPC ..... *H04R 1/2888* (2013.01); *H04R 1/023* (2013.01); *H04R 1/105* (2013.01); *H04R 1/1008* (2013.01); *H04R 1/1058* (2013.01); *H04R 1/225* (2013.01); *H04R 1/288* (2013.01); *H04R 1/2811* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,625,903 | A * | 5/1997 | Schultz | A61F 9/029 2/209 |
| 8,594,351 | B2 * | 11/2013 | Harlow | H04R 1/1016 381/309 |
| 9,794,676 | B2 | 10/2017 | Shetye et al. | |
| 9,794,677 | B2 | 10/2017 | Shetye et al. | |
| 2011/0076289 | A1 | 3/2011 | St. George-Hyslop et al. | |
| 2017/0353793 | A1 | 12/2017 | Sun et al. | |
| 2018/0167710 | A1 | 6/2018 | Silver et al. | |

FOREIGN PATENT DOCUMENTS

| | | | |
|---|---|---|---|
| EP | 2677767 | A2 | 12/2013 |
| WO | 20110076289 | A1 | 6/2011 |

OTHER PUBLICATIONS

U.S. Appl. No. 15/375,119 entitled "Acoustic Transducer" filed Dec. 11, 2016; Applicant: Bose Corporation.

The International Search Report and the Written Opinion of the International Searching Authority dated Oct. 8, 2018 regarding PCT/US2018/041642.

* cited by examiner

*Primary Examiner* — Amir H Etesam

(74) *Attorney, Agent, or Firm* — Brian M. Dingman; Dingman IP Law, PC

(57) ABSTRACT

An audio device with an acoustic radiator that emits acoustic radiation from a first side, a housing that defines an acoustic cavity that receives the acoustic radiation emitted from the first side of the acoustic radiator, and first and second sound-emitting outlets in the housing and acoustically coupled to the acoustic cavity such that the outlets emit sound from the acoustic cavity. The second sound-emitting outlet has a greater equivalent acoustic impedance than the first sound-emitting outlet.

21 Claims, 7 Drawing Sheets

AUDIO DEVICE

BACKGROUND

This disclosure relates to an audio device with a loudspeaker

Intermodulation distortion (IMD) in an acoustic cavity can limit how loud a headset can be played. IMD can occur when relatively large transducer excursions cause the motor force constant to vary, leading to undesired frequency components. Off-ear headphones, where the acoustic radiators are held close to but not on or in the ears, are generally driven at higher amplitude in order to provide desired sound levels to the ears. IMD can become a greater problem at higher amplitude. IMD thus can be a particular problem for off-ear headphones.

SUMMARY

All examples and features mentioned below can be combined in any technically possible way.

In one aspect, an audio device includes an acoustic radiator that emits acoustic radiation from a first side, a housing that defines an acoustic cavity that receives the acoustic radiation emitted from the first side of the acoustic radiator, and first and second sound-emitting outlets in the housing and acoustically coupled to the acoustic cavity such that the outlets emit sound from the acoustic cavity. The second sound-emitting outlet has a greater equivalent acoustic impedance than the first sound-emitting outlet.

Embodiments may include one of the following features, or any combination thereof. The first sound-emitting outlet may emit sound generally along a first sound-emission axis and the second sound-emitting outlet may emit sound generally along a second sound-emission axis. The first and second sound-emission axes may be transverse to the transducer axis. In one non-limiting example, the first and second sound-emission axes are generally perpendicular to the transducer axis. The first and second sound-emitting outlets may have approximately the same area. The second sound-emitting outlet may be covered by a resistive screen. The resistive screen may have an acoustic impedance of about 1000 mks rayl. The ratio of the maximum transducer volume to the volume of the acoustic cavity may be at least about 0.2.

Embodiments may include one of the following features, or any combination thereof. The audio device may further comprise a support structure that is adapted to be worn on a user's body, where the support structure holds the acoustic radiator proximate but not covering an ear of the user when the support structure is worn on the user's body. The first sound-emitting outlet may emit sound directed toward the ear. The second sound-emitting outlet may emit sound directed away from the ear. The first sound-emitting outlet may emit sound generally along a first sound-emission axis, and the second sound-emitting outlet may emit sound generally along a second sound-emission axis. The first and second sound-emitting outlets may be directly opposed to one another such that their sound-emission axes are generally parallel. The first sound-emitting outlet may comprise a first slot in the housing, and the second sound-emitting outlet may comprise a second slot in the housing. The first slot may emit sound generally along a first sound-emission axis, the second slot may emit sound generally along a second sound-emission axis, and the first and second slots may be directly opposed to one another such that their sound-emission axes are generally parallel.

Embodiments may include one of the following features, or any combination thereof. The housing may be generally cylindrical. The housing may comprise a generally circular end wall that is spaced from and opposed to the acoustic radiator, and the acoustic radiator may emit acoustic radiation generally along a transducer axis that is generally perpendicular to the end wall. The housing may further comprise a sidewall that meets the end wall. The first sound-emitting outlet may comprise a first slot in the housing, and the second sound-emitting outlet may comprise a second slot in the housing, wherein the first and second slots are located generally in the sidewall proximate where it meets the end wall. The first and second slots may be diametrically opposed. The first and second slots may each extend around approximately 70 degrees of the periphery of the housing sidewall.

In another aspect, an audio device includes an acoustic radiator that emits acoustic radiation from a first side, and a generally cylindrical housing that defines an acoustic cavity that receives the acoustic radiation emitted from the first side of the acoustic radiator. The housing comprises an end wall that is spaced from and opposed to the acoustic radiator. There is a sidewall that meets the end wall. The acoustic radiator emits acoustic radiation generally along a transducer axis that is generally perpendicular to the end wall. There are first and second sound-emitting outlets in the housing and acoustically coupled to the acoustic cavity such that the outlets emit sound from the acoustic cavity. The first sound-emitting outlet comprises a first slot in the housing and the second sound-emitting outlet comprises a second slot in the housing. The first and second slots are diametrically opposed and are located generally in the sidewall proximate where it meets the end wall. The second sound-emitting outlet may have a greater equivalent acoustic impedance than the first sound-emitting outlet. The acoustic device may further include a headband that is worn on a user's head and holds the acoustic radiator proximate but not covering an ear.

DETAILED DESCRIPTION

The present loudspeaker is typically but not necessarily used in an audio device such as an off-ear headphone. The loudspeaker includes an acoustic radiator (driver) that emits acoustic radiation into a small acoustic cavity defined by a housing. An acoustic cavity with a single sound-emitting outlet has a fundamental resonance, wherein a standing wave within the cavity has a high amplitude at a location opposite the outlet. Depending on the characteristics of the acoustic radiator, this high pressure may modulate the behavior of the radiator in a way to cause IMD. IMD can be reduced by reducing the amplitude of the resonance by creating a second outlet near the region of highest pressure amplitude, opposite the first outlet. If the second sound-emitting outlet is designed to incorporate an acoustically resistive element, such as a tightly woven mesh screen, the amplitude of the resonance can be significantly reduced, thereby reducing IMD. Furthermore, if it is desired that the first outlet direct sound toward the ear, for example on a head-worn audio device, or an audio device worn on the upper torso, then the addition of the resistive element to the second outlet will reduce loss of sound emission desired from the first outlet, across a wide frequency range. If the acoustic impedance of the resistive element is too high, the total acoustic impedance of the second outlet will approach that of a hard wall. An intermediate value of acoustic resistance, between about one and about five times the specific acoustic impedance of air, will reduce the resonance the most. The optimal configuration is an engineering compromise; generally it is best to use a low enough resistance to adequately reduce the amplitude of the fundamental cavity resonance, but keep the resistance high enough to direct most of the sound to go out of the first outlet. A value of around 1000 inks rayls (P*s/m) is often optimal.

Figure 1:
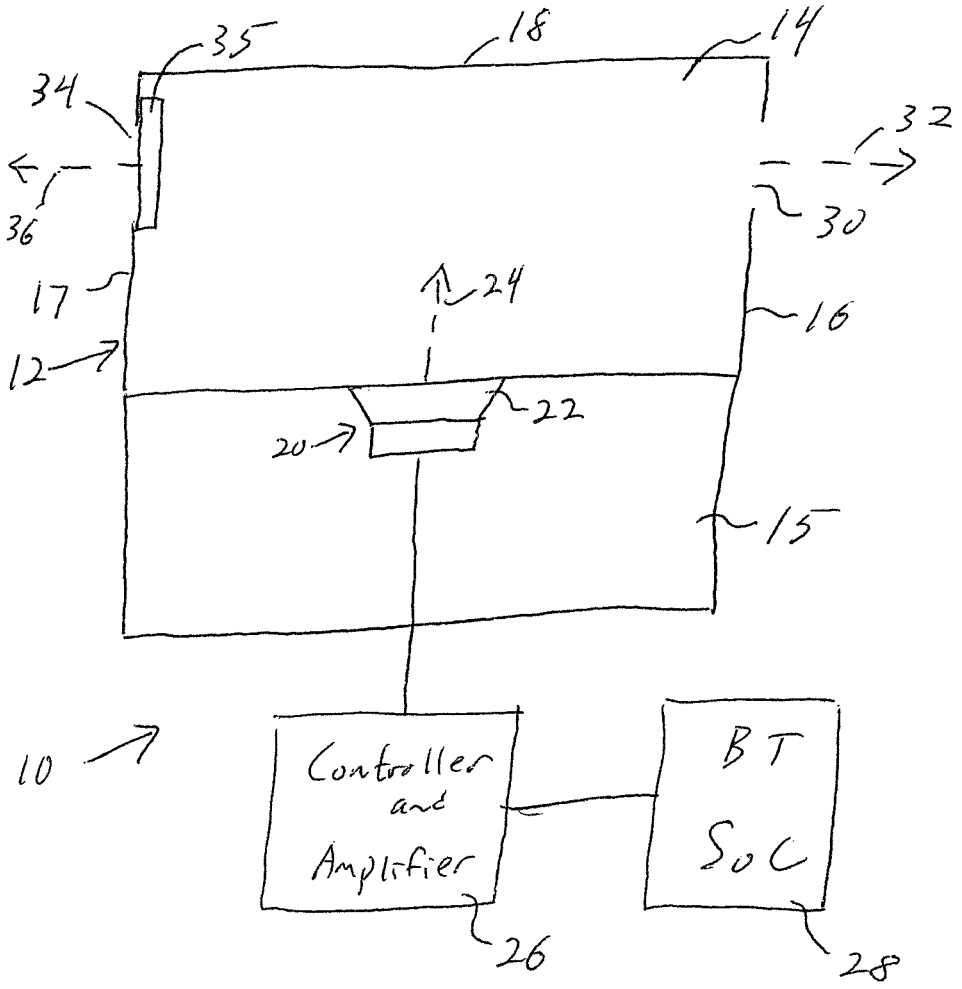
FIG. 1 is schematic diagram of a loudspeaker and components used to drive the loudspeaker transducer.
Figure 2:
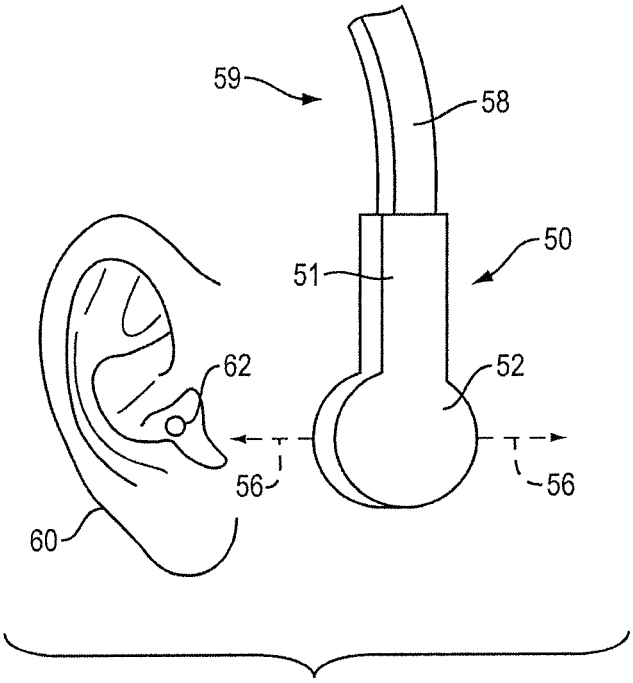
FIG. 2 is a partial side view of an audio device with a loudspeaker located close to but off an ear of a user.
Figure 3A:
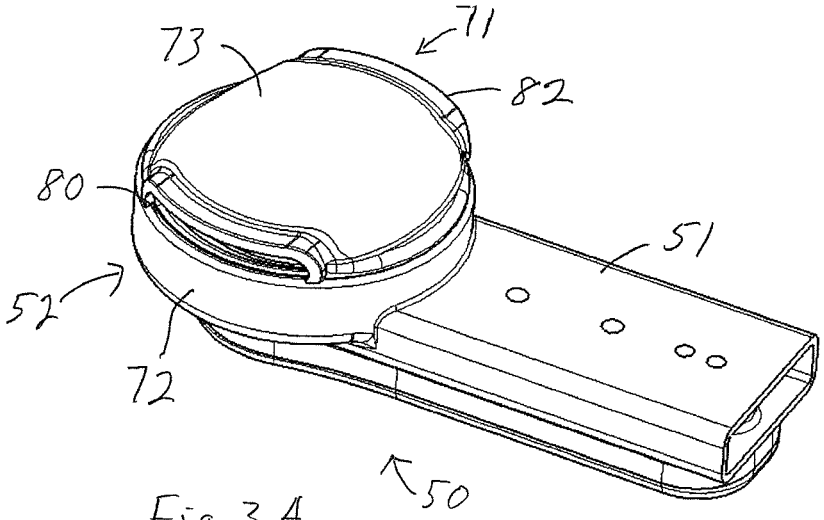
FIG. 3A is a perspective view of the loudspeaker of the audio device of FIG. 2.
Figure 3B:
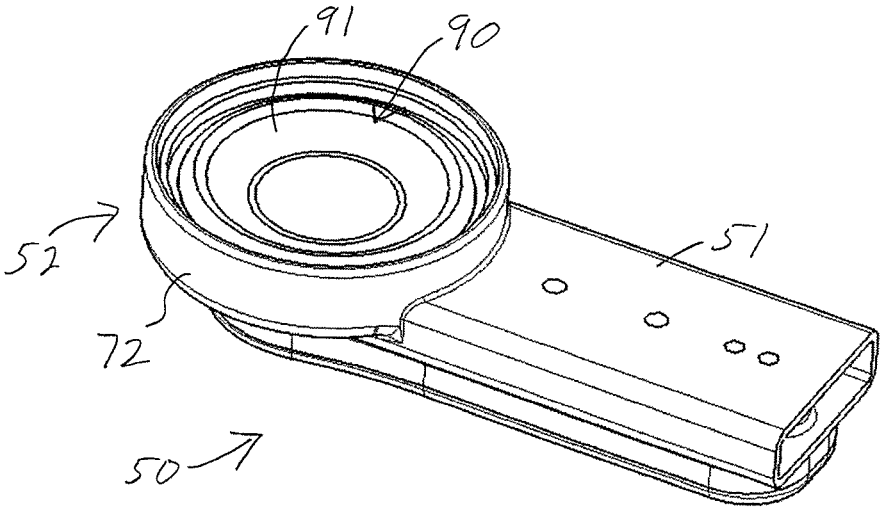
FIG. 3B illustrates the loudspeaker of FIG. 3A with the housing partially disassembled.
Figure 4:
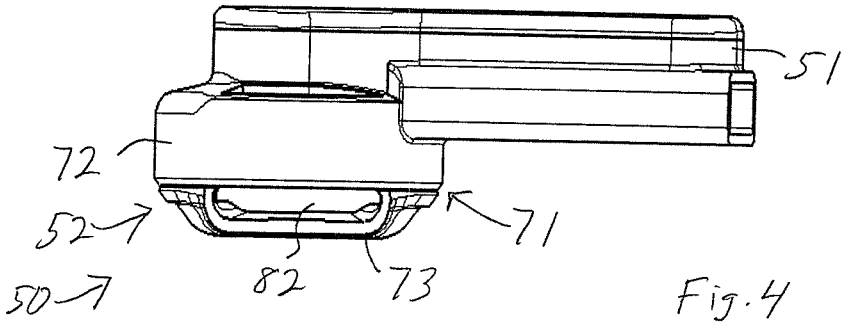
FIG. 4 is a side view of the loudspeaker of FIGS. 2 and 3A.

Elements of FIG. 1 are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

Exemplary loudspeaker 10 is schematically depicted in FIG. 1. Loudspeaker 10 includes acoustic radiator (driver) 20 with diaphragm 22. Driver 20 emits acoustic radiation generally along transducer axis 24 (which is an axis aligned with the axial motion of the transducer cone), into front acoustic cavity 14 that is defined by housing 12 that has sidewalls 16 and 17 and end wall 18. Housing 12 also defines back cavity 15. Housing 12 can have a desired shape, such as generally rectangular or generally cylindrical as two non-limiting examples. A first sound-emitting outlet 30 is acoustically coupled to the acoustic cavity 14, and emits sound generally along axis 32. A second sound-emitting outlet 34 is acoustically coupled to the acoustic cavity 14, and emits sound generally along axis 36. In one non-limiting example, outlets 30 and 34 are in sidewalls 16 and 17, respectively, and are directly opposed such that axes 32 and 36 are at least generally parallel as shown in the drawing. In one non-limiting example, outlets 30 and 34 are the same size and the acoustic impedance of outlet 34 is increased above that of outlet 30 by adding a resistive screen 35 over opening 34. Outlet 34 can be configured to have a greater acoustic impedance that outlet 30 in other ways as well, such as by making outlet 34 smaller than outlet 30. Controller and amplifier module 26 provides acoustic signals that are transduced by driver 20. In some non-limiting cases, such as when loudspeaker 10 is part of wireless headphones, Bluetooth® system on a chip (BT SoC) 28 can wirelessly receive data that is used by module 26 to generate the acoustic signals.

Note that the subject loudspeaker can be used in other wireless or wired headphones, or other configurations of loudspeakers designed to be worn on the body, e.g., on the head or on the upper torso. The subject loudspeaker can also be used in other types of sound sources with relatively small acoustic cavities but that need to generate substantial SPL. Non-limiting examples of audio devices in which the subject loudspeaker can be used include: a neck-work out-loud speaker system that needs to be minimal in size which could have a very small acoustic front cavity wherein IMD could be a problem, and a very thin out-loud speaker such as a sound bar or a portable speaker in which the front acoustic cavity could be very small, particularly in cases in which the outlet is perpendicular to the transducer axis. IMD can be objectionable even if the ear is not near the loudspeaker, since any IMD will radiate into the air and will be heard by the listener if the sound source's SPL is high enough to reach the listener.

In off-ear headphones with a single sound-emitting outlet pointed generally at the ear, standing waves in the acoustic cavity can cause IMD, particularly at higher SPLs. IMD can be reduced by using two sound-emitting outlets in the housing. The SPL from one outlet is directed toward the ear, while the SPL from the other outlet is directed away from the ear. Having two opposed outlets shifts the fundamental cavity resonance upward and thus leads to reduced IMD.

In some non-limiting examples, one sound-emitting outlet is designed to have greater equivalent acoustic impedance than the other. When a first outlet emits SPL directed toward the ear, and the second outlet is opposed to the first outlet, the second outlet may have a greater equivalent acoustic impedance than the first outlet. A result is the flow through the second outlet is minimal except around the fundamental frequency. This can allow for higher SPL with lower IMD at the ear, as well as less spilled sound. Note that the loudspeaker could have more than two sound-emitting outlets.

The second sound-emitting outlet can be designed to present either an inertance or a resistance. Generally, it is expected that a resistance will be a more effective implementation than an inertance. There are a several effects to consider in this regard. For one, it is expected that damping the cavity resonance is likely to reduce IMD because modulation of a damped resonance is less objectionable than modulation of a sharp resonance. A resistance will help damp the cavity resonance, and an inertance will not (except in the respect that it will have some radiation damping). Also, it is expected that shifting the fundamental cavity resonance frequency upward will reduce an IMD interaction with the transducer; both a resistance and inertance can shift the cavity resonance frequency. Further, it is generally desirable to direct sound out of the first sound-emitting outlet toward the ear, especially at low frequencies, but adding one or more additional sound-emitting outlets necessarily diverts/reduces the output from the first outlet.

There is a balance between reducing IMD and leaving sufficient output for the desired purpose of the loudspeaker. With a resistance in the second outlet, the output from the second outlet will have first-order roll-off at low frequencies with respect to the first outlet. With an inertance in the second outlet, the output from the second outlet will be some constant ratio of the first outlet output at low frequencies, like a current divider. The roll-off associated with the resistance is generally preferred. Accordingly, designing the second outlet to exhibit an inertance can likely provide some IMD improvement, but only insomuch as the shifting of the cavity resonance frequency occurs and that frequency is problematic for the loudspeaker. When the second outlet has a resistance the damping of the cavity resonance is likely to help reduce IMD irrespective of the specific transducer.

An exemplary loudspeaker used in an off-ear headphone is shown in FIGS. 2-5. The loudspeaker shown in FIGS. 2-5 is but one non-limiting example of the loudspeaker of the present disclosure, and is not limiting of the scope of the disclosure. Audio device 59 includes loudspeaker 50 and support structure 58 that carries loudspeaker 50 via interface structure 51. Wiring for power and audio signals can be run through structure 51 to acoustic radiator 90 with diaphragm 91. Support structure 58 is typically adapted to be worn on or carried by the body such that loudspeaker 50 is located proximate an ear of the wearer. For example, support structure 58 might be a headband of the type used in headphones, but adapted such that loudspeaker 50 is located near but not on or in ear 60 or ear canal 62. Support structure 58 might also be a nape band, or a support structure that is adapted to be worn in another manner on the head or upper torso of the user. Headbands and nape bands are known in the field and so will not be further described herein.

Figure 5A:
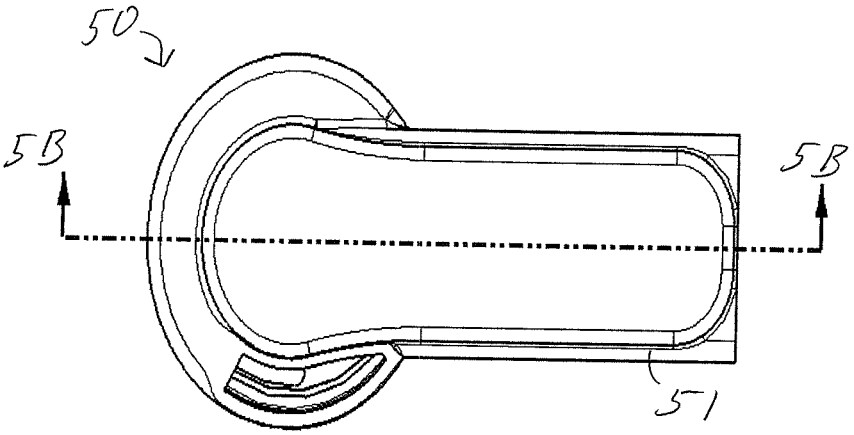
FIG. 5A is a top view of the loudspeaker of FIGS. 2, 3A, and 4.
Figure 5B:
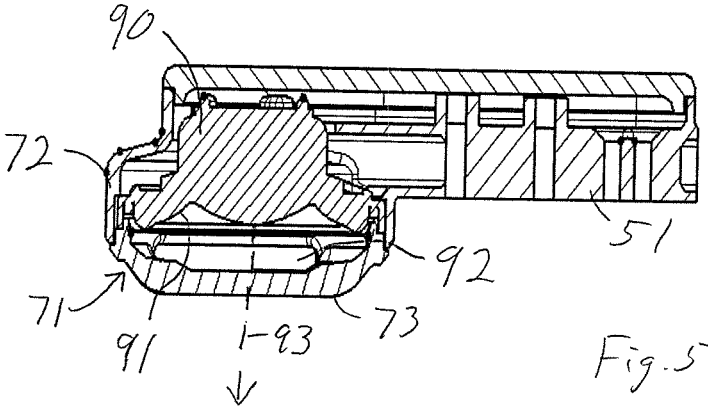
FIG. 5B is a cross-section taken along line 5B-5B of FIG. 5A.

Loudspeaker 50 comprises housing 52 that defines an internal acoustic cavity 92, FIG. 5B. In the present non-limiting example, housing 52 comprises generally cylindrical member (sidewall portion) 72 closed at one end by generally circular end wall 73. Slots 80 and 82 are defined in housing 52 and acoustically communicate with acoustic cavity 92, such that the slots act as sound-emitting outlets. One of the slots (slot 82 in this example) is located such that it emits sound generally along sound-emission axis 54. The other slot (slot 80 in this example) is located such that it emits sound generally along sound-emission axis 56. In some examples, axes 54 and 56 are generally parallel. In some examples, axis 54 is generally directed toward ear 60 or ear canal 62, while axis 56 is generally directed away from the ear. In this example, the emissions along axis 54 provide the primary SPL that is delivered to the ear, while the emissions along axis 56 contribute less to SPL at the ear. Generally, both slots (outlets) behave approximately like point sources, so each is approximately like an omni-directional radiation source, particularly at low frequencies.

Acoustic cavity 92 is relatively small, in part to keep the form factor of the loudspeaker small so it is less obtrusive when worn. As best shown in FIG. 5B, acoustic cavity 92 is bounded on one side by diaphragm 91 and on the opposed side by generally circular end wall 73 which is part of cap 71 that snap fits onto generally cylindrical sidewall portion 72. In one non-limiting example, cavity 92 has a volume of only about 400 $mm^3$. Since diaphragm 91 defines one side of the cavity but moves in and out as it transduces audio signals into sound, its motion varies the cavity volume. One way to define the relative small size of the acoustic cavity is by the ratio of the maximum driver volume displacement (which in the example of diaphragm 91 is about 91 $mm^3$) to the cavity volume (which in the example of cavity 92 is about 400 $mm^3$). This ratio is about 0.23. It is believed that cavities with ratios from somewhat less than 0.23 and greater than 0.23 (perhaps from about 0.2 up) may suffer from the IMD problems described herein and thus may benefit from the solutions described herein. Also, driver 90 emits sound generally along transducer axis 93, which is generally perpendicular to the inside of end wall 73. This arrangement can lead to standing wave fundamental resonances in cavity 92 that lead to IMD at frequencies around the fundamental frequency. If loudspeaker 50 had only a single outlet (e.g., slot 82), standing wave resonances in acoustic cavity 92 lead to IMD at relatively low frequencies. The IMD effectively limits the amplitude of quality sound that can be delivered to the user. Adding a second acoustic cavity outlet (e.g., opposed slot 80) effectively doubles the frequency of cavity standing wave resonances. This leads to less IMD, which allows lower frequencies to be played at higher amplitude and also results in better audio quality.

In one non-limiting example, axes 54 and 56 are transverse to, and more particularly can be generally perpendicular to, axis 93. In one non-limiting example, slots 80 and 82 are identical and are directly opposed such that axes 54 and 56 are essentially coincident. In one non-limiting example, the slots can be about 10.2 mm wide and 1.5 mm high, and extend approximately 70 degrees (for example, 72 degrees) around the circumference of sidewall portion 72. The particular arc length may not have a significant effect on operation of the loudspeaker. However, the larger the arc the less that the outlet will act like a point source, which may limit how loud the sound will be when the outlet is placed near the ear in that longer arcs will have parts of the openings farther from the ear. Also, a longer arc would be expected to lower the fundamental front cavity resonance because it would effectively shorten the longest distance from the wall of the cavity to the outlet. In one non-limiting example, slots 80 and 82 are located just above the upper edge of sidewall portion 72, where it meets cap 71. The slots can be created by properly shaping cap 71 such that when it is engaged on sidewall portion 72 the slots are created by gaps between the cap and the sidewall portion.

Adding the second outlet is effective to decrease IMD. However, each outlet contributes to sound emission from the loudspeaker. In the case where the outlets have the same areas, sound is emitted equally from both outlets. Since one outlet is pointed away from the ear, the second outlet reduces the SPL directed toward the ear. This arrangement also leads to more sound spillage, which is generally undesirable. Higher SPL at the ear and less spillage can be accomplished if the outlet pointed away from the ear (e.g., outlet 80) is arranged to have a higher equivalent acoustic impedance than the outlet pointed toward the ear (e.g., outlet 82). The disparate equivalent acoustic impedances of the two outlets can be accomplished in a convenient manner. One manner is to cover opening 80 with a resistive screen that increases the equivalent acoustic impedance of the covered opening. This is shown in FIG. 1, where screen 35 covers opening 34, while opening 30 is left un-screened, or perhaps screened with a screen with much lower acoustic impedance. In one non-limiting example, screen 35 (or, a screen, not shown, covering opening 80) is a 1000 mks rayl polymer screen made by Saati Americas Corp., with a location in Fountain Inn, S.C., USA. Opening 82 can be left completely open, or can be covered by a 6 mks rayl screen, also available from Saati Americas, that provides some water resistance while not substantially altering the acoustic impedance of the opening. For the loudspeaker shown in FIGS. 2-5, the 1000 mks rayl screen approximately triples the total acoustic impedance of the second opening compared to the first opening. Another manner to achieve different equivalent acoustic impedances would be to create openings with different areas, since impedance is related to area.

Figure 6A:
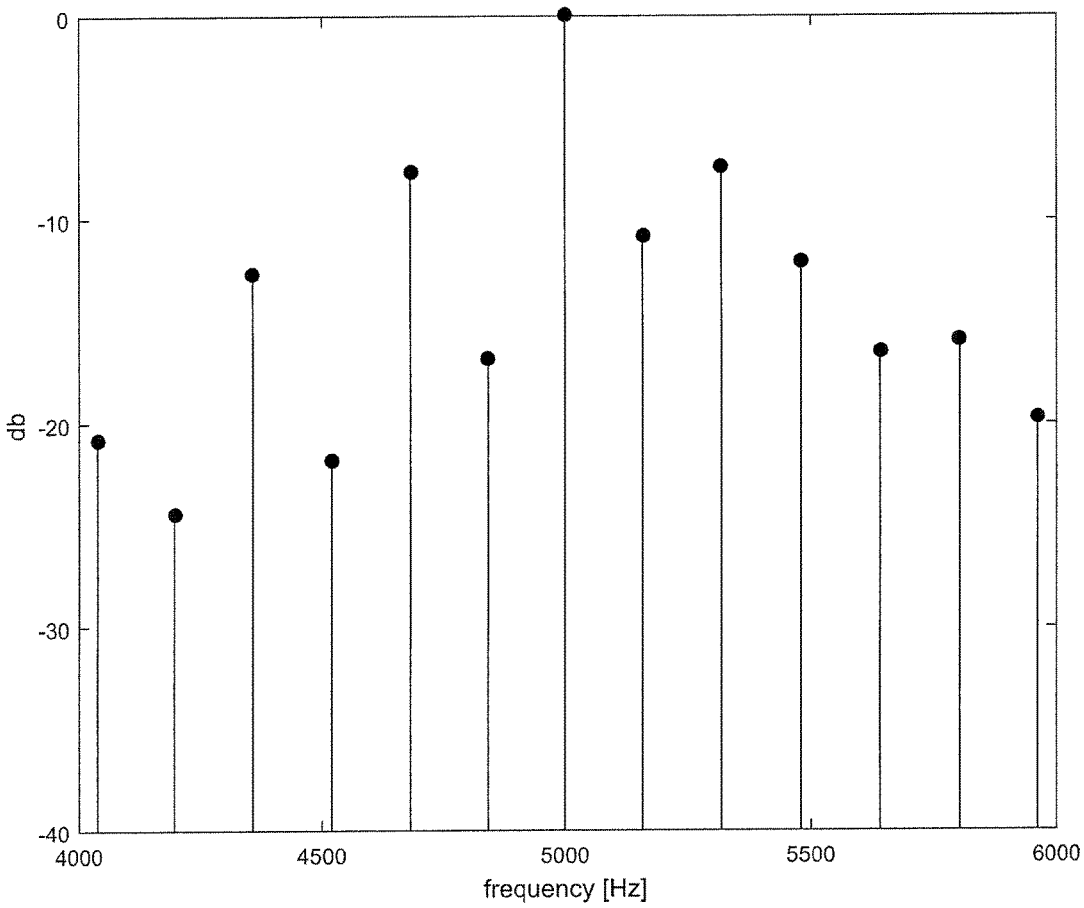
FIGS. 6A, 6B, and 6C are plots that illustrate an example of IMD in the acoustic cavity of the loudspeaker of FIGS. 2-5.
Figure 6B:
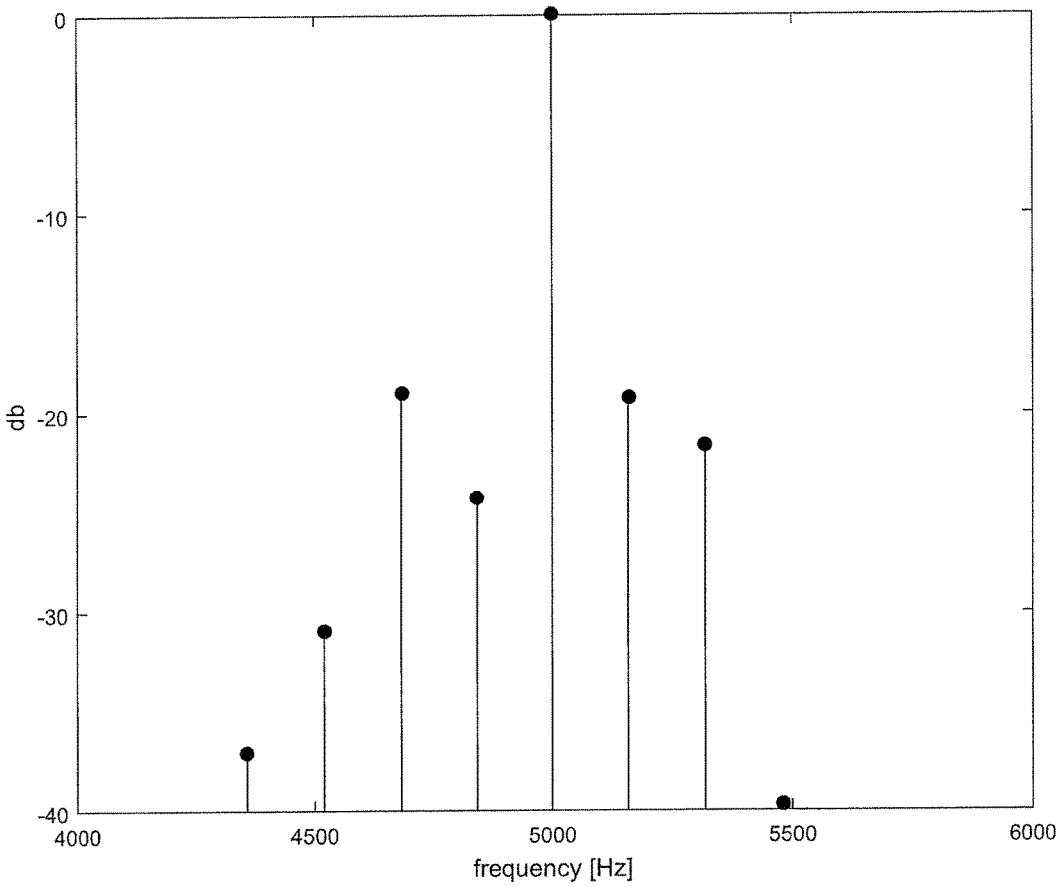
Figure 6C:
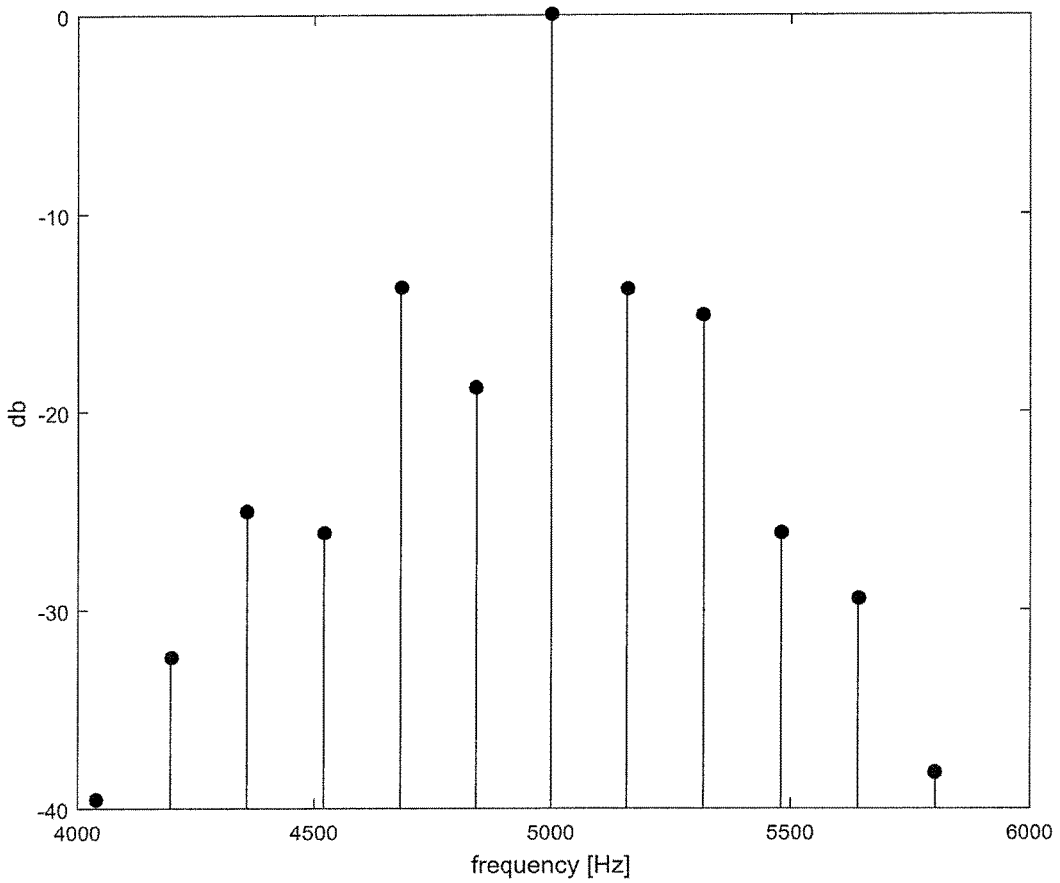

FIGS. 6A-6C illustrate IMD in an acoustic cavity with a single outlet, reductions in IMD when a second identical outlet is added to the acoustic cavity, and changes in IMD and output SPL when the second outlet has a higher effective acoustic impedance than the first outlet, respectively.

The present disclosure relates to a loudspeaker with an acoustic cavity that mitigates a modulation distortion that is believed to arise because of an acoustic resonance across the width of the acoustic cavity into which the driver radiates. In the loudspeaker of FIGS. 2-5, and as illustrated in the plots of FIGS. 6A-6C, the frequency of this resonance is around 5 kHz. When a 5 kHz tone is played in the presence of lower frequency tones that cause large transducer displacement amplitudes, IMD results.

In the tests for which results are presented in FIGS. 6A-6C, the test signal used to develop the data was the sum of two tones, the problematic 5 kHz tone and a typical low frequency of 160 Hz. The 160 Hz input had an amplitude 20 dB higher than the 5 kHz input. In an ideal linear system, the output pressure at the mouth of a single opening in the acoustic cavity would also consist of only these two frequencies. However, the nonlinearities of the acoustic cavity cause the appearance of distortion tones clustered around the 5 kHz output tone at intervals of 160 Hz. In FIGS. 6A-6C, the amplitude of the 5 kHz output is taken to be 0 dB.

The plot of FIG. 6A shows the result for a loudspeaker such as that shown in FIGS. 2-5 but with only a single outlet (which would typically be pointed at the ear) rather than two opposed outlets. The high-level of the distortion products at the distortion frequencies above and below 5 kHz (almost all of which are greater than −10 dB) is judged unacceptable in listening tests with music content. The acoustic resonance at 5 kHz occurs at least in part because of the geometry of the acoustic cavity—its particular size and shape. With one outlet opening, the cavity acts something like a quarter-wave resonance, with a pressure amplitude minimum (nearly zero) at the opening, and a maximum at the opposite wall.

In the plot of FIG. 6B, a second opening is created on the opposite side of the cap (i.e., the loudspeaker is the one shown in FIGS. 2-5). This second opening essentially eliminates the 5 kHz resonance. Distortion is reduced to around −18 dB or less. Half of the sound exits the second opening, which reduces low-frequency pressure at the ear, potentially by up to nearly 6 dB. The result is similar with the cap 71 removed completely (results not shown in the plots). The remaining distortion is thus due to components other than the front cap. It is believed that the remaining distortion is due to system nonlinearities, especially motor force and suspension stiffness variations with axial voice coil position.

Adding a second outlet in the wall opposite the first opening causes there to be a pressure minimum at both openings. With two opposed pressure minima, the resonance occurs at roughly twice the 5 kHz frequency of the original resonance. In the case of the loudspeaker shown in FIGS. 2-5 this new first resonance is at about 8 kHz. The resonance at 8 kHz leads to some distortion at 8 kHz, but this is not an operational problem because the IMD at 8 kHz is minimal, likely because whatever the second interacting factor is that leads to IMD is not prominent at 8 kHz.

In the plot of FIG. 6C, the second opening is covered with 1000 mks rayl acoustic mesh. This increases both output at the primary opening, but also slightly increases distortion. The value of 1000 mks rayl in this case gives a distortion level of around −14 dB at most. Depending on the value of the screen resistance of the second opening, the opening looks more or less like a closed or open wall. But the screen also adds loss, which damps all resonances. The 1000 mks rayl screen used to create the measurements of FIG. 6C is a large value, most of the way to being effectively "closed." If a lower-resistance screen was used, there would be less loss, making that opening look more "open," but more of the SPL would leak out through this second opening.

A number of implementations have been described. Nevertheless, it will be understood that additional modifications may be made without departing from the scope of the inventive concepts described herein, and, accordingly, other embodiments are within the scope of the following claims.

What is claimed is:

1. An audio device, comprising:

an acoustic radiator that emits acoustic radiation from a first side;

a housing that defines an acoustic cavity that receives the acoustic radiation emitted from the first side of the acoustic radiator;

first and second sound-emitting outlets in the housing and acoustically coupled to the acoustic cavity such that the outlets emit sound from the acoustic cavity, wherein the first sound-emitting outlet emits sound generally along a first sound-emission axis and the second sound-emitting outlet emits sound generally along a second sound-emission axis, and wherein the first and second sound-emitting outlets are directly opposed to one another such that their sound-emission axes are generally parallel, wherein the second sound-emitting outlet has a greater equivalent acoustic impedance than the first sound-emitting outlet; and a support structure that is adapted to be worn on a user's body, wherein the support structure holds the housing off of an ear of the user such that the first sound-emitting outlet emits sound directed toward the ear canal.

2. The audio device of claim 1, wherein the acoustic radiator emits acoustic radiation generally along a transducer axis.

3. The audio device of claim 2, wherein the first and second sound-emission axes are transverse to the transducer axis.

4. The audio device of claim 2, wherein the first and second sound-emission axes are generally perpendicular to the transducer axis.

5. The audio device of claim 1, wherein the first and second sound-emitting outlets have approximately the same area.

6. The audio device of claim 5, wherein the second sound-emitting outlet is covered by a resistive screen.

7. The audio device of claim 6, wherein the resistive screen has an acoustic impedance of about 1000 mks rayl.

8. The audio device of claim 1, wherein the support structure holds the acoustic radiator proximate but not covering any part of the ear.

9. The audio device of claim 1, wherein the second sound-emitting outlet emits sound directed away from the ear.

10. The audio device of claim 1, wherein the first sound-emitting outlet comprises a first slot in the housing, and the second sound-emitting outlet comprises a second slot in the housing.

11. The audio device of claim 10, wherein the first slot emits sound generally along the first sound-emission axis and the second slot emits sound generally along the second sound-emission axis, and wherein the first and second slots are directly opposed to one another such that their sound-emission axes are generally parallel.

12. The audio device of claim 1, wherein the housing is generally cylindrical.

13. The audio device of claim 12, wherein the housing comprises a generally circular end wall that is spaced from and opposed to the acoustic radiator, and the acoustic radiator emits acoustic radiation generally along a transducer axis that is generally perpendicular to the end wall.

14. The audio device of claim 13, wherein the housing further comprises a sidewall that meets the end wall, and wherein the first sound-emitting outlet comprises a first slot in the housing and the second sound-emitting outlet comprises a second slot in the housing, wherein the first and second slots are located generally in the sidewall proximate where it meets the end wall.

15. The audio device of claim 14, wherein the first and second slots are diametrically opposed.

16. The audio device of claim 15, wherein the first and second slots each extend around approximately 70 degrees of the periphery of the housing sidewall.

17. The audio device of claim 1, wherein a ratio of a maximum transducer volume displacement to a volume of the acoustic cavity is at least about 0.2.

18. An audio device, comprising:

an acoustic radiator that emits acoustic radiation from a first side;

a generally cylindrical housing that defines an acoustic cavity that receives the acoustic radiation emitted from the first side of the acoustic radiator, wherein the housing comprises an end wall that is spaced from and opposed to the acoustic radiator, and a sidewall that meets the end wall;

wherein the acoustic radiator emits acoustic radiation generally along a transducer axis that is generally perpendicular to the end wall;

first and second sound-emitting outlets in the housing and acoustically coupled to the acoustic cavity such that the outlets emit sound from the acoustic cavity;

wherein the first sound-emitting outlet comprises a first slot in the housing and the second sound-emitting outlet comprises a second slot in the housing, wherein the first and second slots are diametrically opposed and are located generally in the sidewall proximate where it meets the end wall; and a support structure that is adapted to be worn on a user's body, wherein the support structure holds the housing off of an ear of the user such that the first sound-emitting outlet emits sound directed toward the ear canal.

19. The audio device of claim 18, wherein the second sound-emitting outlet has a greater equivalent acoustic impedance than the first sound-emitting outlet.

20. The audio device of claim 19, wherein the support structure comprises a headband that is adapted to be worn on a user's head, wherein the headband holds the acoustic radiator proximate but not covering any part of the ear of the user.

21. The audio device of claim 20, wherein the second sound-emitting outlet emits sound directed away from the ear.

* * * * *